US007529494B2

(12) United States Patent
Won

(10) Patent No.: US 7,529,494 B2
(45) Date of Patent: May 5, 2009

(54) IMAGE FORMING APPARATUS AND PAPER TRANSPORTING APPARATUS

(75) Inventor: Jung-yun Won, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/390,439

(22) Filed: Mar. 28, 2006

(65) Prior Publication Data

US 2006/0263129 A1 Nov. 23, 2006

(30) Foreign Application Priority Data

May 19, 2005 (KR) ..... 10-2005-0042064

(51) Int. Cl.
*G03G 15/20* (2006.01)

(52) U.S. Cl. ..... 399/68; 399/400; 399/405; 400/185

(58) Field of Classification Search ..... 400/59, 400/569, 605, 196.1, 184, 600.2, 224, 320, 400/525, 185; 399/401, 254, 262, 405, 69, 399/400, 68; 271/202, 203
See application file for complete search history.

(56) References Cited

U.S. PATENT DOCUMENTS

| | | | | |
|---|---|---|---|---|
| 5,540,426 | A * | 7/1996 | Nakamura et al. | 271/265.01 |
| 5,713,059 | A * | 1/1998 | Ishikawa | 399/18 |
| 5,799,237 | A * | 8/1998 | Ueda et al. | 399/367 |
| 6,263,186 | B1 * | 7/2001 | Okamoto et al. | 399/388 |
| 6,473,590 | B2 * | 10/2002 | Matsumoto et al. | 399/404 |
| 2003/0057632 | A1 * | 3/2003 | Nishimura et al. | 271/69 |
| 2004/0046851 | A1 * | 3/2004 | Yang et al. | 347/104 |
| 2005/0111064 | A1 * | 5/2005 | Iwasaki | 358/514 |
| 2005/0220505 | A1 * | 10/2005 | Hashimoto et al. | 399/322 |
| 2005/0269759 | A1 * | 12/2005 | Sano et al. | 271/3.01 |

FOREIGN PATENT DOCUMENTS

| | | |
|---|---|---|
| JP | 58-021768 | 2/1983 |
| JP | 59-128146 | 7/1984 |
| JP | 4-45058 | 2/1992 |
| JP | 5-16569 | 1/1993 |
| JP | 05-307292 | 11/1993 |
| JP | 06-211406 | 8/1994 |
| JP | 9-202503 | 8/1997 |
| JP | 2000-109258 | 4/2000 |

OTHER PUBLICATIONS

Office Action issued in Japanese Patent Application No. 2006-140610 on Mar. 10, 2009.

* cited by examiner

*Primary Examiner*—Leslie J Evanisko
*Assistant Examiner*—Matthew G Marini
(74) *Attorney, Agent, or Firm*—Stein, McEwen & Bui, LLP

(57) ABSTRACT

An image forming apparatus discharging a printed medium at a stable speed. A image developer affixes an image to a printing medium to form a printed medium and a transporting roller moves the printed medium toward a discharge roller. A one-way clutch driving the transport roller permits the discharge roller to assert control over the printed medium while the printed medium is in contact with the transport roller. The discharge roller is controllable to accelerate and decelerate the printed medium so that printed media are orderly stacked. The one way clutch permits the discharge roller and the transport roller to be spaced apart less than a length of the printed medium.

17 Claims, 6 Drawing Sheets

IMAGE FORMING APPARATUS AND PAPER TRANSPORTING APPARATUS

CROSS-REFERENCE TO RELATED APPLICATIONS

This application claims the benefit of Korean Patent Application No. 2005-42064, filed on May 19, 2005, in the Korean Intellectual Property Office, the disclosure of which is incorporated herein by reference.

BACKGROUND OF THE INVENTION

1. Field of the Invention

An aspect of the present invention relates to an image forming apparatus, and more particularly, to an image forming apparatus discharging a printing paper at a stable speed.

2. Description of the Related Art

Generally, an image forming apparatus includes a paper providing unit, a developing unit, a fixing unit and a paper discharging unit. The paper providing unit provides a printing paper to the developing unit, which selectively applies developer to the printing paper, thereby forming an image. The fixing unit fixes the applied developer to the printing paper. The paper discharging unit receives the printing paper on which the image is formed and discharges the paper having the formed image to the outside of the image forming apparatus. Although the term "printing paper" is used as a convenience in describing aspects of the present invention, the present invention is applicable to printable media other than paper, such as for example, plastic sheets.

The developing unit includes a photosensitive body, a light scanning unit, a developing roller and a transferring roller. When the light scanning unit transfers light containing printing image information to the photosensitive body, an electrostatic latent image is formed by a potential difference on the photosensitive body. The developing roller provides the developer to the electrostatic latent image on the photosensitive body and develops the electrostatic latent image, and the transferring roller transfers a development image formed on the photosensitive body to the printing paper.

In order to improve printing speed, the printing paper is transported in the apparatus at high speed. All of the paper providing unit, the developing unit, the fixing unit and the paper discharging unit transport the printing paper at high speed. However, the printing speed should decelerate to a predetermined speed or less at the moment the printing paper is last discharged to the outside of the apparatus. Therefore, the paper discharging unit transports the printing paper at variable speed.

FIG. 1 is a schematic view of a conventional image forming apparatus. The image forming apparatus 100 includes a paper providing roller part 160, a developing part 110, a fixing roller part 120, a transporting roller part 140 and a paper discharging roller part 130. The paper providing roller part 160 includes a pickup roller 162 picking up a printing paper (P) from a paper providing tray (not shown) and a feeding roller 164 feeding the printing paper (P) to the developing part 110.

The developing part 110 selectively applies developer to the printing paper (P) according to a developing process. The fixing roller part 120 includes a pair of fixing rollers and receives the printing paper (P) to which the developer is applied from the developing part 110 and fixes the developer to the printing paper (P), thereby forming an image.

The transporting roller part 130 includes a transporting roller 142 receiving the printing paper (P) from the fixing roller part 120 and transporting the printing paper (P) to the paper discharging roller part 130 and a transporting roller driving part 144 driving the transporting roller 142. The transporting roller driving part 144 drives the transporting roller 142 in order to transport the printing paper (P) at the same speed as the fixing roller part 120 transports the printing paper (P), using a same driving motor as the fixing roller part 120 so as not to influence the speed at which the fixing roller part 120 fixes the printing paper (P).

The paper discharging roller part 130 includes a paper discharging roller 132 discharging the printing paper (P) to a paper storing part 150 and a paper discharging roller driving part 134 driving the paper discharging roller 132. The printing paper (P) is orderly transported by the paper providing roller part 160, the developing part 110, the fixing roller part 120 and the transporting roller part 140 so as to be printed at high speed.

When the paper discharging roller part 130 and the transporting roller part discharge the printing paper (P) to the paper storing part 150 at high speed, a following printing paper (P) is stacked before a former printing paper (P) is settled and the printing papers (P) may not be properly stacked in the paper storing part 150. Therefore, after receiving the printing paper (P) from the transporting roller part 140 at high speed, the paper discharging roller part 130 discharges the printing paper (P) at a predetermined decelerated speed before discharging the printing paper (P) to the paper storing part 150, and then transports the following printing paper (P) at the original high speed.

FIG. 2 is a graph showing a transporting speed pattern of the paper discharging roller part in FIG. 1. A horizontal axis shows time and a vertical axis shows a transporting speed of the printing paper (P) of the paper discharging roller part 130. Time 'a' shows a time at which a lower part of the printing paper (P) leaves the fixing roller part 120, time 'b' shows a time at which the lower part of the printing paper (P) leaves the transporting roller part 140, and time 'c' shows a time at which the lower part of the printing paper leaves the paper discharging roller part 130. Line Vp shows the transporting speed pattern of the image forming apparatus 100.

The fixing roller part 120 and the transporting roller part 140 regularly transport the printing paper P at a high fixing speed V1. The paper discharging roller part 130 continues transporting the printing paper (P) at V1, the same speed as the fixing speed V1, until the time 'b' so as not to disturb the fixing roller part 120 in fixing the printing paper. The paper discharging roller part 130 decelerates down to a discharging speed V3 at the time 'c' and discharges the printing paper (P), and then returns the discharging speed to a fixing speed V1. In order to increase an interval between the printing papers (P) so that the former printing paper is not contacted with the following printing paper when the printing paper is decelerateadly transported between time 'b' and time 'c', the paper discharging roller part 130 acceleratedly transports the printing paper (P) up to a predetermined accelerated speed V2 after time 'b', and thereafter deceleratedly transports the printing paper (P) down to the discharging speed V3.

However, the conventional image forming apparatus 100 may not correctly discharge the printing paper (P) since the printing speed decelerates at a sufficiently stable speed as the printing speed becomes higher-speed. Since the fixing speed V1 becomes an even higher-speed as the printing speed becomes high-speed, a difference in transporting speed at which the paper discharging roller part 130 should decelerate from time 'b' to time 'c' becomes large, and a time interval between time 'b' and the time 'c' may become short. Therefore, the paper discharging roller part 130 accelerates the transporting speed between the time 'b' and the time 'c', and then may not decelerate the transporting speed back to stable speed. Accordingly, the printing paper (P) is discharged and transported at a speed which is not sufficiently decelerated to be stable, thereby the printing paper is incorrectly stacked.

To discharge the printing paper at stable speed, the transporting roller part 140 may be spaced from the paper discharging roller part 130 in order to extend the interval between the time 'b' and the time 'c'. However, the distance between the transporting roller part 140 and the paper discharging roller part 130 may not be more than the maximum length of the printing paper (P). Otherwise, the printing paper (P) may not be stably transported. Increasing a transporting interval between the printing papers may obtain time to decelerate the transporting speed, however, increasing the transporting interval makes the printing speed slower.

SUMMARY OF THE INVENTION

Accordingly, an aspect of the present invention is to provide an image forming apparatus and a paper transporting apparatus capable of discharging printing papers at stable speed.

The foregoing and/or other aspects of the present invention are achieved by providing an image forming apparatus including a developing part applying a developer to a printing paper, the developing part including a fixing roller part receiving the printing paper from the developing part and fixing the developer to the printing paper; a paper discharging roller part receiving the printing paper from the fixing roller part and discharging it at a transporting speed pattern; and a transporting roller part including a transporting roller interposed between the fixing roller part and the paper discharging roller part and transporting the printing paper from the fixing roller part to the paper discharging roller part, a transporting roller driving part driving the transporting roller in a transporting-rotating direction so that the transporting roller transports the printing paper at a first speed, and a one-way clutch interposed between the transporting roller and the transporting roller driving part and transmitting driving force of the transporting roller driving part to the transporting roller only in the transporting-rotating direction.

According to an embodiment of the present invention, the paper discharging roller part starts to accelerate the transporting speed of the printing paper at least after the printing paper leaves the fixing roller part, and accelerates the printing paper up to a second speed at least exceeding the first speed, and then decelerates the printing paper down to a third speed less than the first speed when the printing paper leaves the paper discharging roller part.

According to the embodiment of the present invention, the fixing roller part and the paper discharging roller part are disposed at an interval within at least the length of the printing paper along the progress path of the printing paper.

The foregoing and/or other aspects of the present invention are also achieved by providing a paper transporting apparatus interposed between a fixing roller part fixing a developer to a printing paper and a paper discharging roller part discharging the printing paper and transporting the printing paper from the fixing roller part to the paper discharging roller part, the paper transporting apparatus including a transporting roller receiving the printing paper from the fixing roller part and transporting the printing paper to the paper discharging roller part; a transporting roller driving part driving the transporting roller at a predetermined angular velocity in a transporting-rotating direction; and a one-way clutch interposed between the transporting roller and the transporting roller driving part and transmitting driving force of the transporting roller driving part to the transporting roller only in the transporting-rotating direction.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects and advantages of the present invention will become apparent and more readily appreciated from the following description of the exemplary embodiments, taken in conjunction with the accompanying drawings of which.

DETAILED DESCRIPTION OF THE EMBODIMENTS

Figure 1:
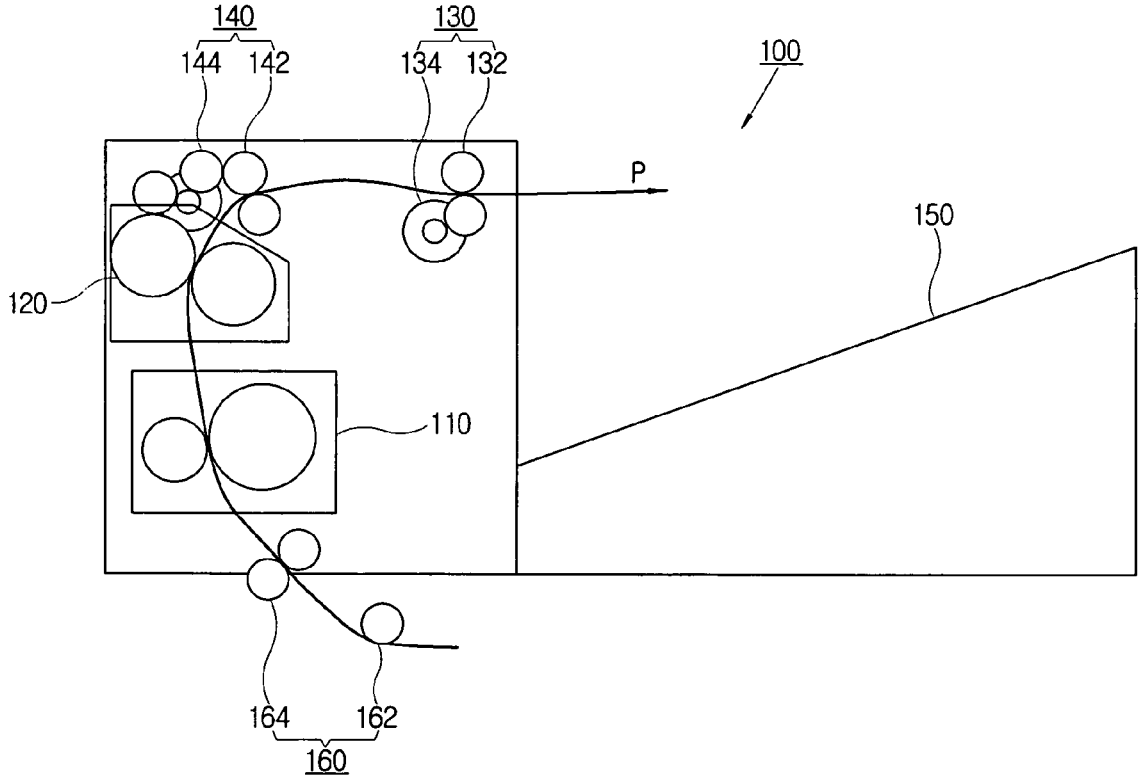
FIG. 1 (PRIOR ART)
FIG. 1 is a schematic view of a conventional image forming apparatus.
Figure 2:
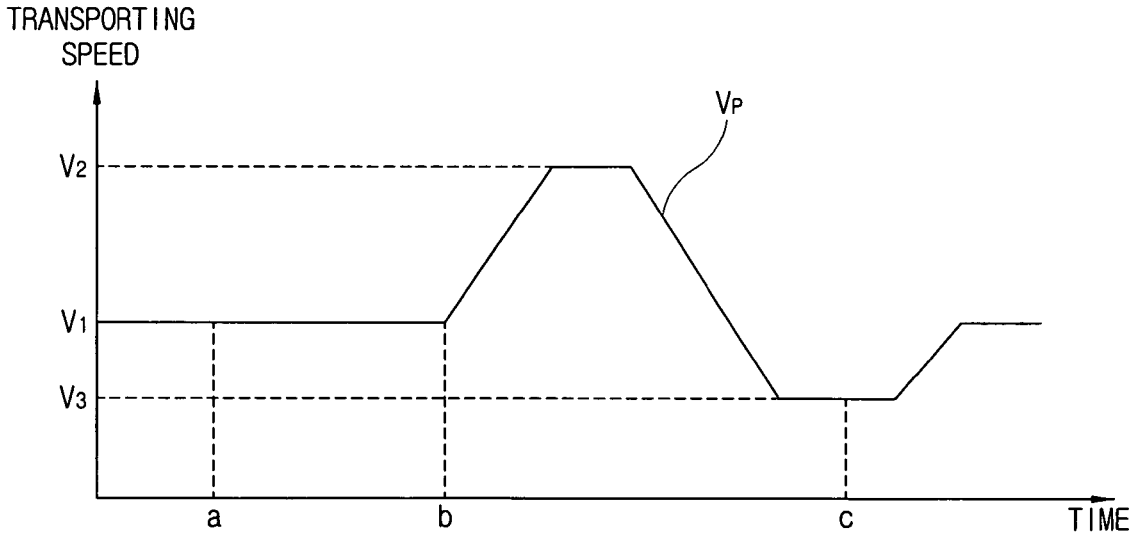
FIG. 2 (PRIOR ART)
FIG. 2 is graph showing a transporting speed pattern of a paper discharging roller part shown in FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
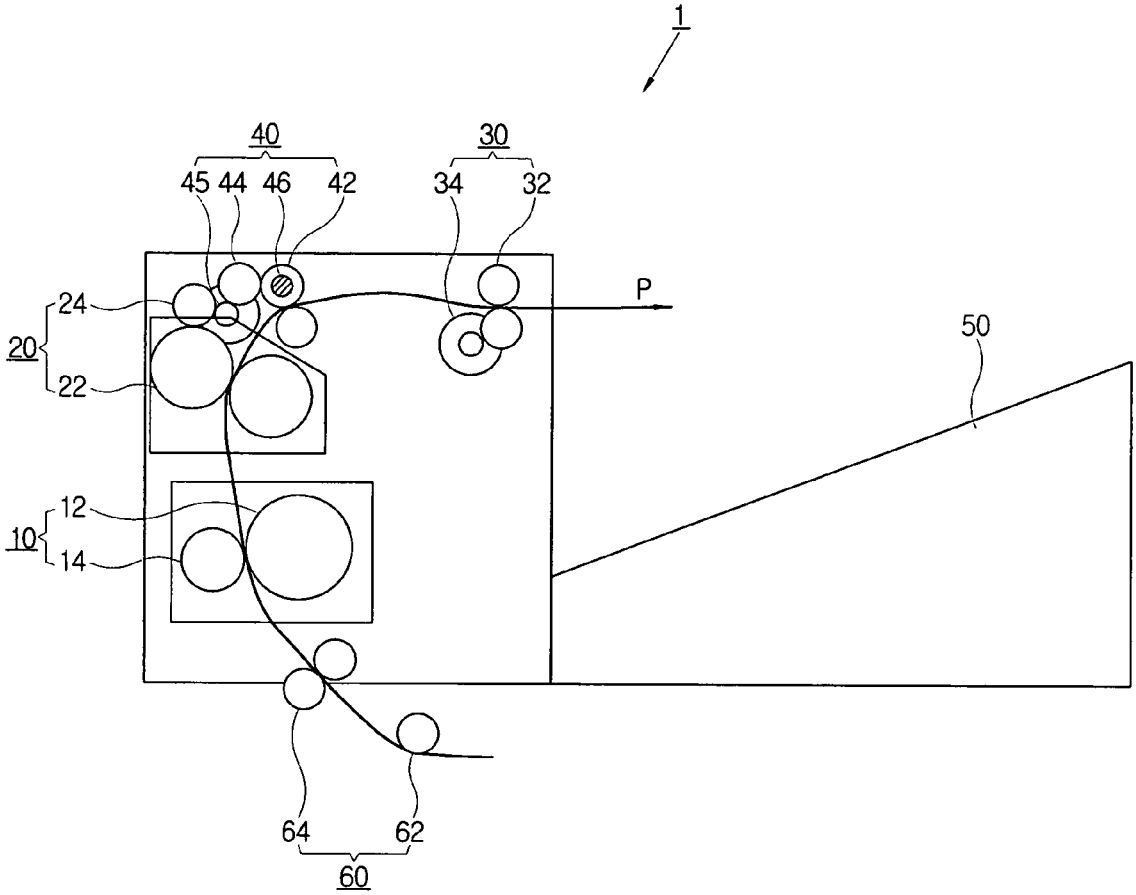
FIG. 3 is a schematic view of an image forming apparatus according to an embodiment of the present invention.
Figure 4:
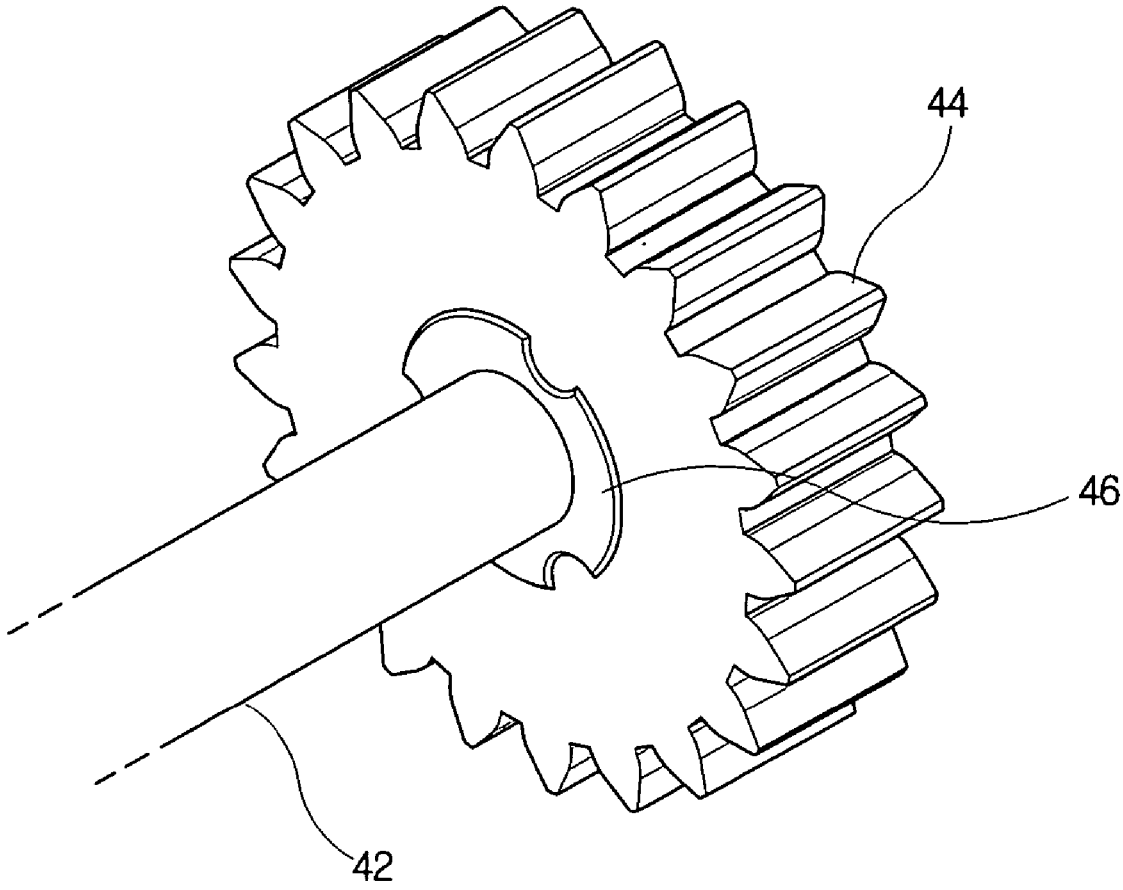
FIG. 4 is a schematic view of a transporting roller part in FIG. 3.

FIG. 3 is a schematic view of an image forming apparatus according to an embodiment of the present invention and FIG. 4 is a schematic view of a transporting roller part schematically shown in FIG. 3.

Referring to FIG. 3, an image forming apparatus 1 includes a paper providing roller part 60, a developing part 10, a fixing roller part 20, a transporting roller part 40 and a paper discharging roller part 30. A printing paper (P) orderly passes through the paper providing roller part 60, the developing part 10, the fixing roller part 20, the transporting roller part 40 and the paper discharging roller part 30, thereby forming printing images.

The paper providing roller part 60 receives the printing paper (P) from a paper providing tray (not shown) and provides the printing paper (P) to the developing part 10. The paper providing roller part 60 includes a pickup roller 62 and a feeding roller 64. The pickup roller 62 picks up the printing papers (P) by a sheet stacked in the paper providing tray. The feeding roller 64 receives the printing paper (P) from the pickup roller 62 and feeds the printing paper (P) to the developing part 10.

The developing part 10 selectively applies a developer in order to form images on the printing paper (P) provided by the paper providing roller part 60. The developing part 10 includes a photosensitive body 12 and a transferring roller 14. A light scanning unit (not shown) scans light, based on printing image information, thereby forming an electrostatic latent image on the photosensitive body 12. The developing roller (not shown) is provided with the developer from a developer providing part (not shown) and provides the developer to the electrostatic latent image of the photosensitive body 12, thereby developing the image. The transferring roller 14, using a potential difference, transfers the developer applied to the photosensitive body 12 to the printing paper (P) passing between the photosensitive body 12 and the transferring roller 14.

The fixing roller part 20 fixes the developer applied on the printing paper (P) while receiving the printing paper from the developing part 10 and transporting the printing paper (P) to the transporting roller part 40, thereby completing the image. The fixing roller part 20 includes a fixing roller 22 and a fixing roller driving part 24. The fixing roller 22 may include a pair of rollers respectively heating and pressurizing the printing paper passing between the pair of rollers. The fixing roller driving part 24 drives the fixing roller 22 at a predetermined speed so that the fixing roller 22 fixes the developer on the printing paper (P) as well as transports the printing paper (P) at the predetermined speed.

The transporting roller part 40, which is interposed between the fixing roller part 20 and the paper discharging roller part 30, receives the printing paper (P) from the fixing roller part 20 and transports the printing paper (P) to the paper discharging roller part 30. The transporting roller part 40 includes a transporting roller 42, a transporting roller driving part 44 and a one-way clutch 46.

Figure 5:
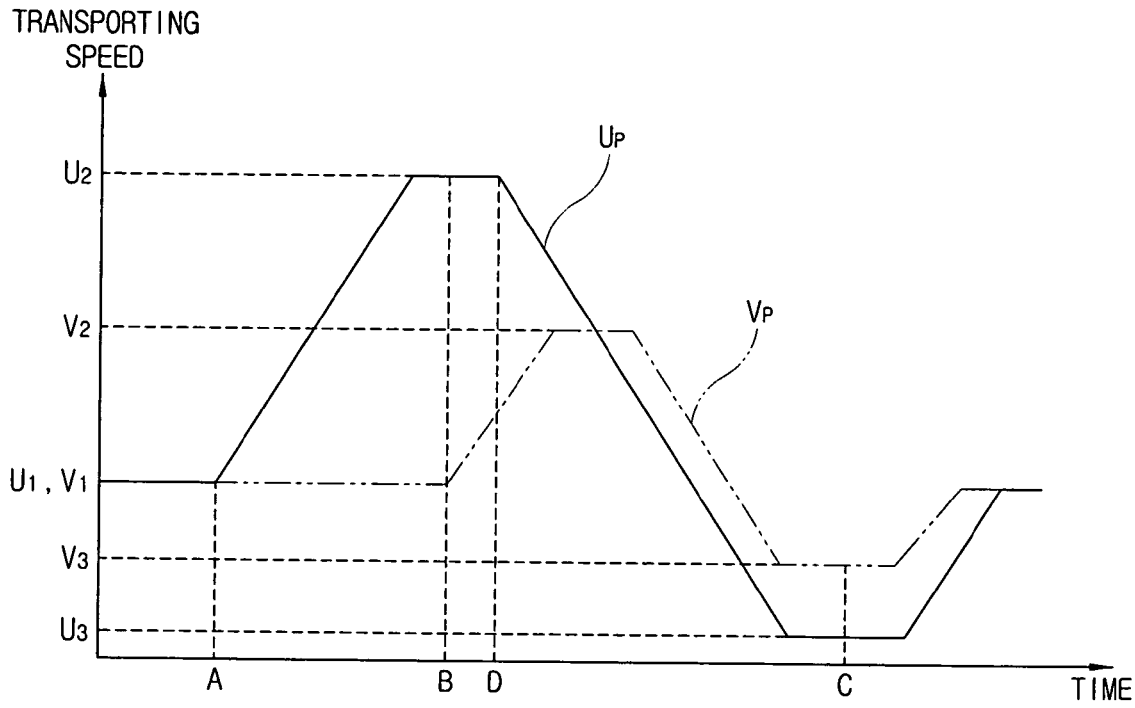
FIG. 5 is a graph showing a transporting speed pattern of a paper discharging roller part in FIG. 3.

The transporting roller 42 transports the printing paper (P) from the fixing roller part 20 to the paper discharging roller part 30. The transporting roller driving part 44 is provided with a driving force from a driving motor 45 and rotates the transporting roller 42 at a predetermined angular velocity so that the transporting roller 42 transports the printing paper (P) at a first speed U1, as shown in FIG. 5. The transporting roller driving part 44 may be an electric-powered device such as a gear, a pulley, etc.

The first speed U1 at which the transporting roller 42 transports the printing paper (P) may be the same speed as at which the fixing roller part 20 transports the printing paper (P) so as not to disturb the fixing roller part 20 in fixing the printing paper (P). For maintaining the transporting speed, the fixing roller 22 may also be provided with rotary force from the driving motor 45 providing rotary force to the transporting roller 42. As long as the first speed U1 is made to be the same speed as the fixing roller part 20 transports the printing paper (P), the transporting roller 42 and the fixing roller 22 may be driven by separate motors.

The one-way clutch 46 is interposed between the transporting roller 42 and the transporting roller driving part 44 and transmits the driving force of the transporting roller driving part 44 to the transporting roller 42 only in a same transporting-rotating direction as the transporting roller 42 transports the printing paper (P) from the fixing roller part 20 to the paper discharging roller part 30. The one-way clutch 46 does not transmit the driving force of the transporting roller driving part 44 to the transporting roller 42 in the opposite transporting-rotating direction.

Accordingly, when the transporting roller 42 is applied with a force causing an angular velocity more than an angular velocity at which the transporting roller driving part 44 rotates the transporting roller 42 in the transporting-rotating direction, the transporting roller 42 is idle-rotated. Therefore, the transporting roller 42 may not only transport the printing paper (P) in the direction of the paper discharging roller part 30 at the first speed U1 by the transporting roller driving part 44, but the transporting roller 42 may also be rotated in the direction of the paper discharging roller part 30 without being restricted by the transporting roller driving part 44, so the printing paper (P) may stably be transported to the paper discharging roller part 30 at the first speed U1 or more. The well-known one-way clutch 46 is used in the embodiment, which is disclosed in the Korean First Publication No. 2004-77442.

The paper discharging roller part 30 receives the printing paper(P) from the fixing roller part 20 and discharges the printing paper (P) at a predetermined transporting speed pattern. The image forming apparatus 1 includes a paper storing part 50 where the printing papers (P) on which the image is formed are stacked. The paper discharging roller part 30 discharges the printing paper (P) on which the image is formed to the paper storing part 50.

The paper discharging roller part 30 includes a paper discharging roller 32 and a paper discharging roller driving part 34. The paper discharging roller driving part 34 drives the paper discharging roller 32 so that the paper discharging roller 32 transports the printing paper (P) according to the transporting speed pattern. The paper discharging roller driving part 34 may have a separate driving motor from the transporting roller driving part 44. The paper discharging roller driving part 34 may drive the paper discharging roller 32 at the transporting speed pattern by varying the paper discharging roller's 32 transporting speed by a well-known controller.

The paper discharging roller part 30 starts to accelerate the transporting speed of the printing paper (P), at least after the printing paper (P) leaves the fixing roller part 20, and keeps accelerating the speed up to a second speed U2 exceeding the first speed U1. Thereafter, the paper discharging roller part 30 decelerates the transporting speed of the printing paper (P) down to a third speed U3 less than the first speed U1 when the printing paper (P) leaves the paper discharging roller part 30.

The paper discharging roller part 30 starts to accelerate the transporting speed immediately after the printing paper (P) leaves the fixing roller part 20 and increases the speed to the second speed U2. Accordingly, the transporting interval between the printing paper (P) in the middle of transporting and the following printing paper (P) becomes longer, thereby providing time to decelerate the speed. The paper discharging roller part 30 may also accelerate the transporting speed after the printing paper (P) leaves the fixing roller part 20. The second speed U2 is at least exceeding the first speed U1 and may be enough to space the transporting interval between the printing papers (P) at a predetermined interval.

The transporting roller 42 is not restricted by the transporting roller driving part 44 driving due to the one-way clutch 46 and is operated at the transporting speed exceeding the first speed U1 by tension the paper discharging roller part 30 gives to the printing paper (P), thereby transporting the printing paper (P) at the second speed U2. Therefore, the transporting roller 42 may become free from the accelerating start point limitation that the transporting speed cannot start to be accelerated until the printing paper (P) leaves the transporting roller 42 which is gear driven along with the fixing roller 22 so as not to prevent the fixing roller part 20 from fixing the printing paper (P). Since the paper discharging roller part 30 may accelerate the transporting speed as soon as the printing paper (P) leaves the fixing roller part 20, additional time may be obtained to accelerate or decelerate the transporting speed of the paper discharging roller part 30 as much as the interval between the point the printing paper (P) leaves the fixing roller part 20 and the point the printing paper (P) leaves the transporting roller part 40.

The paper discharging roller part 30 accelerates the transporting speed up to the second speed U2, and thereafter decelerates the transporting speed down to the third speed U3 before the printing paper (P) is discharged to the paper storing part 50. The third speed U3 is at least less than the first speed U1 and is preferably low enough that the printing paper (P) may stably be stacked in the paper storing part 50. The paper discharging roller part 30 decelerates a discharging speed of the printing paper (P) to the third speed U3, which is stably low, and discharges the printing paper (P) to the paper storing part 50, thereby discharging at the stably low speed when finally discharging the printing paper (P) transported through the developing part 10, the fixing roller part 20, etc., at high speed.

The fixing roller part 20 and the paper discharging roller part 30 may be disposed in the course of the printing paper (P) at the interval within the length of the printing paper (P). The printing paper (P) is transported by at least two of the fixing roller part 20, the transporting roller part 40 or the paper discharging roller part 30, not a single roller part, at any location, thereby improving transporting stability.

When the fixing roller part 20 and the paper discharging roller part 30 are disposed in the course of the printing paper (P) at the interval more than the length of the printing paper (P), the printing paper (P) may be transported by only the transporting roller part 40 before the printing paper (P) is received to the paper discharging roller part 30, although the printing paper (P) leaves the fixing roller part 20. However, the paper discharging roller part 30 starts to accelerate immediately after the printing paper (P) leaves the fixing roller part 20, receives the printing paper (P) at the predetermined accelerated speed and transports the printing paper (P).

Further, the paper discharging roller part 30 may start to accelerate after the printing paper (P) is received by the discharging roller 30.

Figure 6A:
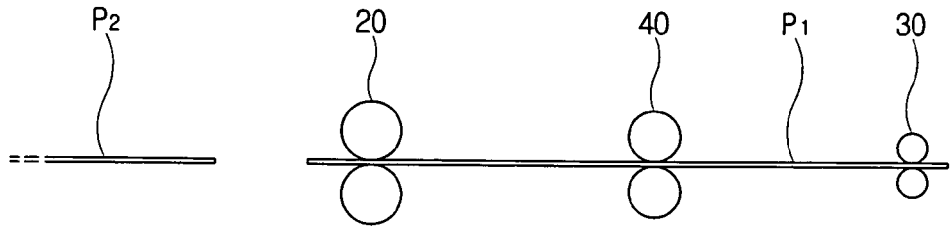
FIGS. 6A-6D are schematic views to illustrate transporting a printing paper by the paper discharging roller part in FIG. 3.
Figure 6B:
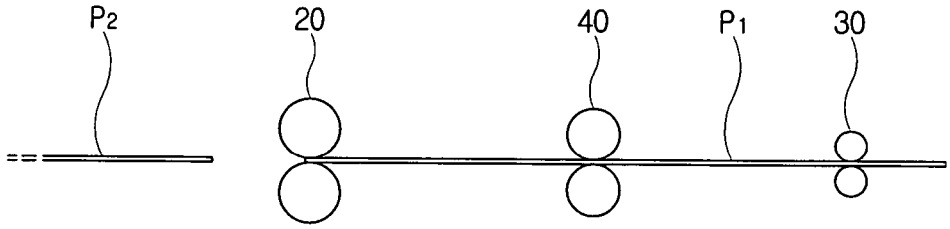
Figure 6C:
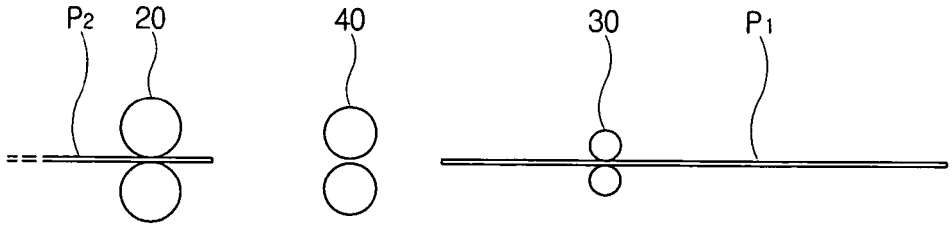
Figure 6D:
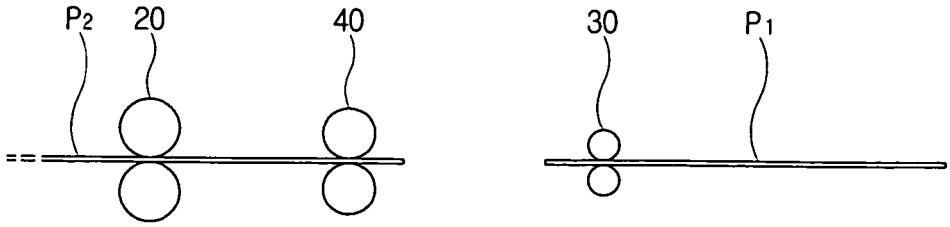

Hereinafter, functions of the image forming apparatus will be described by reference to FIGS. 5, 6A, 6B, 6C and 6D. FIG. 5 is a graph showing a transporting speed pattern of the paper discharging roller part 30; and FIGS. 6A-6D are schematic views to illustrate transporting the printing paper by the paper discharging roller part. A horizontal axis shows time and a vertical axis shows a transporting speed of the printing paper (P) of the paper discharging roller part 30. Referring to FIG. 5, a time 'A' shows the time at which a lower part of the printing paper (P) leaves the fixing roller part 20, a time 'B' shows the time at which the lower part of the printing paper (P) leaves the transporting roller part 40, a time 'C' shows the time at which the lower part of the printing paper leaves the paper discharging roller part 30, and a time 'D' shows the time at which the paper discharging roller part 30 starts to decelerate the transporting speed. Line 'Up' shows the transporting speed pattern of the paper discharging roller part 30 according to the embodiment of the present invention and line 'Vp' shows the transporting speed pattern of the conventional image forming apparatus. FIG. 6A shows a fixing condition of the printing paper (P), FIG. 6B corresponds to the time 'A' in FIG. 5, FIG. 6C corresponds to the time 'D' in FIG. 5, and FIG. 6D corresponds to a time before the time 'C' in FIG. 5.

When the printing paper (P) is in the fixing condition, the upper part of the printing paper (P) is received by the paper discharging roller part 30 due to the fixing roller part 20 transporting the printing paper (P) at a first speed U1. At this point, the paper discharging roller part 30 transports the printing paper (P) at the first speed U1 so as not to disturb the fixing roller part 20 in its function. (See FIG. 6A.)

Immediately after the lower part of the printing paper (P) leaves the fixing roller part 20 (the time 'A'), the paper discharging roller part 30 starts to accelerate, then transports the printing paper (P) at a second speed U2 until the time 'D' where the printing paper (P) starts to decelerate. At the point where the printing paper (P) starts to decelerate, the transporting roller 42 exceeds the speed by the first speed U1 by the one-way clutch 46 and may transport the printing paper (P) at the same speed as the paper discharging roller part 30. Accordingly, the interval between the printing papers (P1, P2) may be sufficient. (See FIGS. 6B and 6C)

At the time D, when the paper discharging roller part 30 starts to decelerate the transporting speed, the transporting speed should be at least the first speed U1 when the lower part of the printing paper (P) leaves the transporting roller part 40 while being deceleratedly transported.

The paper discharging roller part 30 transports the printing paper (P) at a third speed U3 at the moment when the lower part of the printing paper (P) leaves the paper discharging roller part 30 (time 'C'). Accordingly, the printing paper (P) is discharged at the sufficiently stable speed, thereby well being stacked in the paper storing part 50. The paper discharging roller part 30, after discharging the printing paper P1, accelerates and prepares to receive the next printing paper P2 at the first speed U1. The paper discharging roller part 30 transports the printing papers (P) at the transporting speed pattern.

The image forming apparatus 1 includes the transporting roller part 40 equipped with the one-way clutch 46, thereby extending an available time that the paper discharging roller part 30 may start as much as the interval between time 'A' and time 'B'. Therefore, the image forming apparatus 1 may obtain an additional time to accelerate or decelerate the transporting speed of the paper discharging roller part 30 without extending the interval between the printing papers (P) or the interval of disposition between the fixing roller part 20 and the paper discharging roller part 30.

Accordingly, the printing paper (P) may be discharged at the third speed U3 lower than the conventional discharging speed V3 at time 'C'.

A paper transporting apparatus according to the embodiment of the present invention will be described with reference to FIGS. 3 and 4. The paper transporting apparatus 40 is interposed between the fixing roller part 20 fixing the printing paper (P) and the paper discharging roller part 30 discharging the printing paper (P), thereby transporting the printing paper (P) from the fixing roller part 20 to the paper discharging roller part 30.

The paper transporting apparatus 40 includes the transporting roller 42, the transporting roller driving part 44, and the one-way clutch 46. The transporting roller 42 receives the printing paper P from the fixing roller part 20 and transports the printing paper to the paper discharging roller part 30. The transporting roller driving part 44 drives the transporting roller 42 at a predetermined angular velocity in the transporting-rotating direction. Accordingly, the transporting roller 42 may transport the printing paper (P) from the fixing roller part 20 to the paper discharging roller part 30 at the predetermined transporting speed.

The one-way clutch 46 is interposed between the transporting roller 42 and the transporting roller driving part 44 and transmits driving force of the transporting roller driving part 44 to the transporting roller 42 only in the transporting-rotating direction. Therefore, the transporting roller 42 may be idle-rotated at the predetermined angular velocity or more by the transporting roller driving part 44.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus having a developer to apply developing material to a printing medium, the apparatus comprising:

a fixing roller to fix the developing material to the printing medium;

a paper discharging roller to discharge the printing medium according to a transporting speed pattern in which the printing medium is accelerated from a first speed to a second speed after the developing material is fixed to the printing medium and then the printing medium is decelerated from the second speed to a third speed that is slower than the first speed before the printing medium leaves the paper discharging roller; and a transporter comprising:

a transporting roller, interposed between the fixing roller and the paper discharging roller, to transport the printing medium from the fixing roller to the paper discharging roller, a driver to drive the transporting roller in a transporting direction at the first speed, and a one-way clutch, interposed between the transporting roller and the driver, to transmit a driving force of the driver to the transporting roller only in the transporting directions, wherein the paper discharging roller begins accelerating the printing medium from the first speed to the second speed after the printing medium leaves the fixing roller and before the printing medium leaves the transporting roller.

2. The image forming apparatus according to claim 1, wherein the fixing roller and the paper discharging roller are disposed at an interval within a length of the printing medium along a progress path thereof.

3. The image forming apparatus according to claim 1, wherein the one way clutch idle-rotates the transport roller at the second speed in the transporting direction when the printing medium is accelerated from the first speed to the second speed.

4. The image forming apparatus according to claim 1, wherein the one way clutch idle-rotates the transport roller in the transporting direction when the transport roller is rotated at a speed greater than the first speed while the transport roller is driven at the first speed by the driver.

5. A paper transporting apparatus between a fixing roller to fix a developed image to a printing medium and a paper discharging roller to discharge the printing medium, the apparatus comprising:

a transporting roller to receive the printing medium from the fixing roller and to transport the printing medium to the paper discharging roller;

a driver to drive the transporting roller at a predetermined angular velocity in a transporting direction; and a one-way clutch, interposed between the transporting roller and the driver, to transmit a driving force of the driver to the transporting roller only in the transporting direction to cooperate with the paper discharging roller so as to enable the printing medium to be accelerated from a first speed, which corresponds to the predetermined angular velocity, to a second speed after the developed image is fixed to the printing medium and before the printing medium leaves the transporting roller, and then to be decelerated from the second speed to a third speed, which is slower than the first speed, before the printing medium leaves the paper discharging roller.

6. The paper transporting apparatus according to claim 5, wherein the one way clutch idle-rotates the transporting roller at the second speed in the transporting direction when the printing medium is accelerated from the first speed to the second speed.

7. The paper transporting apparatus according to claim 5, wherein the one way clutch idle-rotates the transporting roller in the transporting direction when the transporting roller is rotated at an angular velocity that is greater than the predetermined angular velocity while the transporting roller is driven at the predetermined angular velocity by the driver.

8. An image forming apparatus, comprising:

a developer to form a toner image on a printing medium;

a fixing roller to fix the toner image to the printing medium;

a transport roller to transport the printing medium after the toner image is fixed to the printing medium;

a driver to drive the transport roller;

a discharge roller to discharge the printing medium in a paper discharging direction; and a one-way clutch, interposed between the transport roller and the driver, to allow the driver to transmit a driving force to the transport roller only in the paper discharging direction, to cooperate with the discharge roller so as to enable the printing medium to be accelerated from a first speed to a second speed after the toner image is fixed to the printing medium and before the printing medium leaves the transport roller, and then to be decelerated from the second speed to a third speed, which is slower than the first speed, before the printing medium leaves the paper discharging roller.

9. The image forming apparatus of claim 8, wherein the discharge roller accelerates and decelerates the printing medium in the paper discharging direction according to a transporting speed pattern.

10. The image forming apparatus of claim 9, wherein the discharge roller accelerates the printing medium while the printing medium is in contact with the transport roller.

11. The image forming apparatus of claim 8, wherein a spacing between the transport roller and the discharge roller is less than a length of the printing medium in the paper discharging direction.

12. The image forming apparatus of claim 8, wherein the discharge roller accelerates and decelerates the printing medium in the paper discharging direction as soon as the printing medium leaves the fixing roller.

13. The image forming apparatus of claim 8, wherein during at least a part of a printing cycle, the printing medium is simultaneously urged in the paper discharging direction by both the fixing roller and the transport roller.

14. The image forming apparatus of claim 8, wherein during at least a part of a printing cycle, the printing medium is simultaneously urged in the paper discharging direction by both the transport roller and the discharge roller.

15. The image forming apparatus of claim 8, wherein the discharge roller decelerates the printing medium from the second speed to the third speed less than the first speed prior to outputting the printing medium from the image forming apparatus.

16. The image forming apparatus of claim 8, wherein the one way clutch idle-rotates the transport roller at the second speed in the paper discharging direction when the printing medium is accelerated from the first speed to the second speed.

17. The image forming apparatus of claim 8, wherein the one way clutch idle-rotates the transport roller in the paper discharging direction when the transport roller is rotated at a speed greater than the first speed while the transport roller is driven at the first speed by the driver.

* * * * *

UNITED STATES PATENT AND TRADEMARK OFFICE

CERTIFICATE OF CORRECTION

PATENT NO. : 7,529,494 B2
APPLICATION NO. : 11/390439
DATED : May 5, 2009
INVENTOR(S) : Jung-yun Won It is certified that error appears in the above-identified patent and that said Letters Patent is hereby corrected as shown below:

Column 9, line 25, change “directions” to --direction--.

Signed and Sealed this

Fourteenth Day of July, 2009

JOHN DOLL
*Acting Director of the United States Patent and Trademark Office*